United States Patent [19]

Johanson, deceased

[11] Patent Number: 4,779,067

[45] Date of Patent: Oct. 18, 1988

[54] MICROWAVE PHASE TRIMMER

[75] Inventor: John E. Johanson, deceased, late of Boonton, N.J., by Edna L. Johanson, executrix

[73] Assignee: Johanson Manufacturing Corporation, Boonton, N.J.

[21] Appl. No.: 798,078

[22] Filed: Nov. 14, 1985

[51] Int. Cl.[4] ..... H01P 1/18

[52] U.S. Cl. ..... 333/160; 333/156; 333/245

[58] Field of Search ..... 333/156, 160, 161, 202, 333/206, 207, 219, 223, 235, 260, 138–140, 245

[56] References Cited

U.S. PATENT DOCUMENTS

| | | | |
|---|---|---|---|
| 2,437,067 | 3/1948 | Bingley | 333/160 |
| 2,644,140 | 6/1953 | Pease | 333/160 |
| 2,786,184 | 3/1957 | Alford | 333/160 |
| 2,828,471 | 3/1958 | Hall | 333/260 |
| 3,705,379 | 12/1972 | Bogar | 333/260 |

OTHER PUBLICATIONS

Bruno–"Phase Adjustable SMA Connector", Conference: 8th Annual Connector Symposium, Cherry Hill, N.J., USA, 22–23 Oct. 1975; pp. 198–202.

*Primary Examiner*—Marvin L. Nussbaum
*Attorney, Agent, or Firm*—Pennie & Edmonds

[57] ABSTRACT

An adjustable coaxial cable connecting means is provided for serially connecting the adjacent ends of two cables. A turnbuckle sleeve having an open interior cylindrical wall surface, with opposite open ends of the interior wall surface having threads of equal but opposite pitch. A central coaxial conductor comprising telescoping male and female connectors slidably connecting at their central inner most ends, the male and female connectors each having means for connection to one of the central conductors of a coupled coaxial cable. These are the components needed in order to alter the electrical length of the coupler by rotational adjustment of the turnbuckle sleeve. The electrical length of the coupler may be altered by rotational adjustment of said turnbuckle sleeve.

4 Claims, 2 Drawing Sheets

MICROWAVE PHASE TRIMMER

FIELD OF INVENTION

The invention relates to apparatus which can be installed in a microwave transmission line to control the line length and therefore the relative phase angle of the wave energy transmitted.

BACKGROUND OF INVENTION

For many years the microwave industry has been phase matching lengths of microwave transmission lines in order to optimize performance of phase dependent components and systems. The traditional method of physically cutting off or trimming incremental lengths of line was later augmented by "sliding trombone" type devices which eliminated cutting but adversely affected size, weight and reliability. Other common disadvantages of both methods include their lack of high resolution tuning, difficulty of adjustment and connecting interface compatibility.

DESCRIPTION OF INVENTION

In accordance with the invention, a central cylindrical turnbuckle is provided which is threaded on the internal wall surface with threads of opposite pitch. Two threaded cable retaining sleeves are provided, one for each end of the turnbuckle. The threads on each sleeve are preferably evenly but, oppositely pitched so that rotation of the turnbuckle will cause both ends of the cable to move inwardly to shorten the line or to move outwardly and thereby lengthen the line.

Preferably the threaded cable retaining sleeves are slotted to provide "glitch" resistant tuning. The slotted rotor sleeve contacts allow the line to be adjusted during systems operation without fear of transients which could otherwise destroy microwave semiconductors in transmitter circuits.

The multi-turn concept permits fractional degree adjustment with relative ease. Unlike the "cut and try" method, phase-trimming can easily be reset in the factory or the field. Complicated phased array radar systems employ the use of many solid state modules which are interconnected one to another. Should module replacement become necessary due to failure or battle damage, the exact phase adjustment could be regained. This field resetability could spell the difference between a functional or non-functional radar system. The resetability feature is provided by the use of locknuts and the turnbuckle design. The turnbuckle's differential threads allow it to be rotated without disturbing the angular relationship of the phase cable. This is especially important where the cable is bent to conformal profiles. It is important to understand that rebending short lengths of 0.085" or 0.141" diameter and semi-rigid cable almost always results in stress fracture of the copper shield. Under normal conditions this is a catastrophic event.

It is an object of the present invention to overcome the disadvantages of the prior art and to provide a low cost improved phase trimmer device which is easy to install and operate and easy to adjust during operation.

BRIEF DESCRIPTION OF DRAWINGS

Referring to FIG. 1 of the drawings, there is shown, in exploded view form, a preferred embodiment of the invention. A sleeve turnbuckle 10 is adapted to receive the open ends of a coaxial cable passing through cable sleeves 11 and 12 with the center conductors being terminated respectively in interconnecting pins 15 and 16. Locknuts 13 and 14 are threaded on the interior wall surfaces to match the exterior wall surface threads of 11 and 12 (see FIGS. 4 and 5). Cable sleeves 11 and 12 advantageously include a pair of slots 17, 18 formed in the side wall portion of the rotor 31 where the threads have been removed. The pairs of slots 17, 18 serve to provide a frictional lock of the respective threads with the interior threads of 10. As shown in FIG. 3, the slots 17, 18 are preferably compressed prior to use to provide the desired tension between the mating threads. Operation of the slots as a frictional lock is given in U.S. Pat. No. Re. 30,406, the teachings of which are incorporated herein by reference.

Referring to FIGS. 4 and 5, there is shown an enlarged sectional view of an assembled coaxial line extender. Coaxial cable 21 is inserted into cable sleeve 11 so that the central conductor 40 fits snugly into pin connector 41. Similarly, central connector 40(*a*) is inserted into 41(*b*). Locknuts 13 and 14 are tightened as shown in FIG. 5 once the line length has been determined. Since threads 50 and 51 are of opposite pitch, the effective length of the line may be adjusted by turning the turnbuckle 10 to provide a differential adjustment of the line.

In FIG. 4, the electrical length o the line as illustrated is approximately maximum with interconnection pins 15 and 16 contacting as shown. In FIG. 5, the electrical length of the interconnected line 20 and 21 is reduced by the telescoped interconnection of pins 15 and 16.

Figure 1:
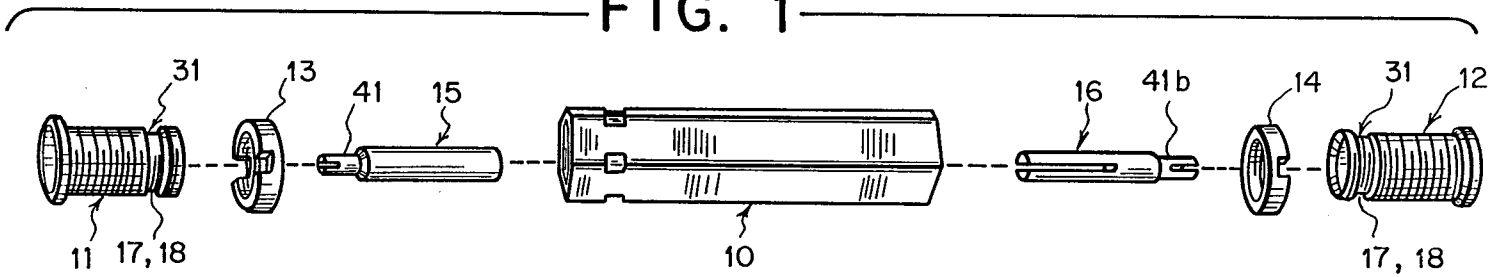
FIG. 1 is an exploded perspective view of the phase trimmer provided by the invention.
Figure 3:
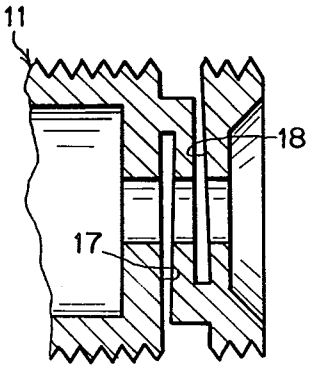
FIG. 3 is an enlarged cross-sectional view of the slotted cable sleeves.
Figure 2:
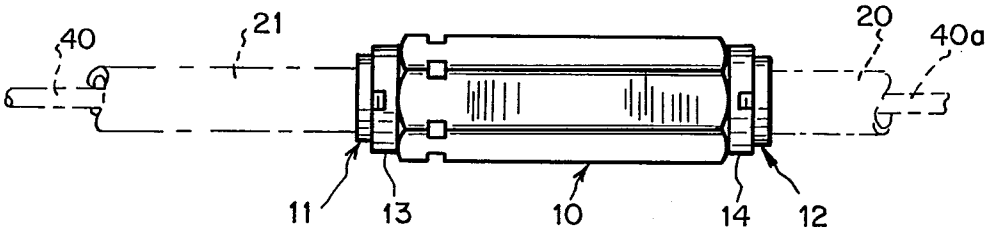
FIG. 2 is an assembled side view of the phase trimmer.
Figure 4:
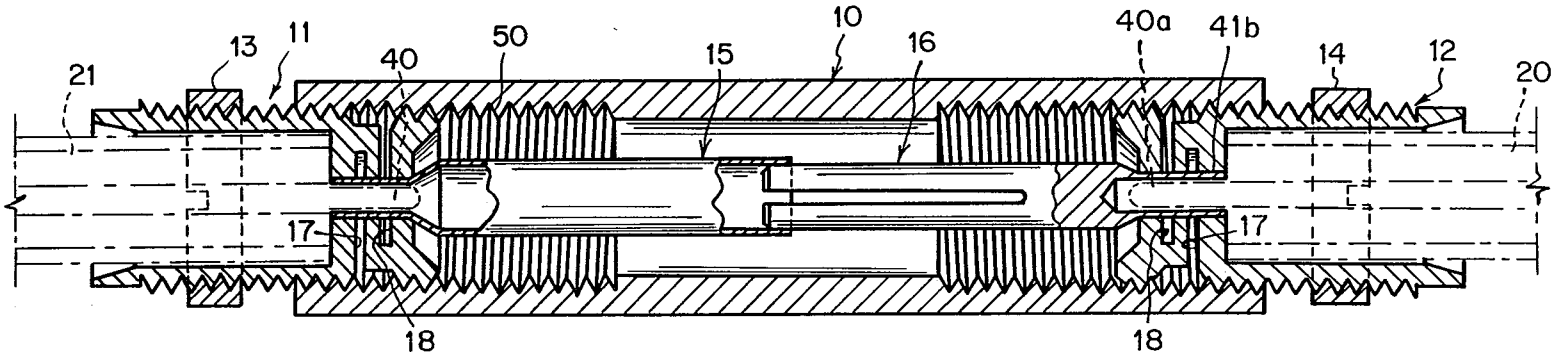
FIG. 4 is a cross-sectional view of the phase trimmer in an initial stage of adjustment.
Figure 5:
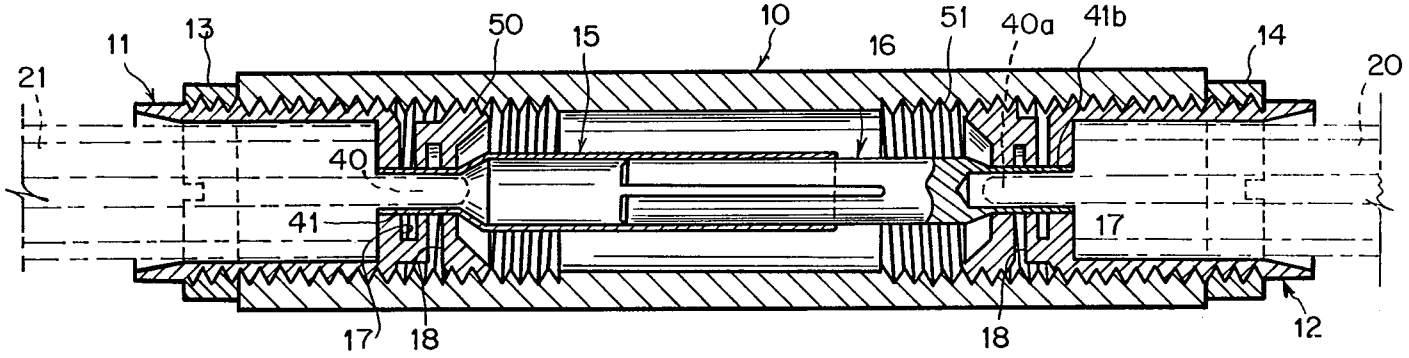
FIG. 5 is a cross-sectional view of an assembled phase trimmer with locknuts in locked position.

It will be appreciated by those skilled in the art that locknuts 13 and 14 may be omitted and the friction provided by the slots 17 and 18 may be relied upon for holding the cable sleeves in the desired preset position. Where the desired sleeve position is known, the cable sleeves 11 and 12 may be soldered to the turnbuckle 10 to establish the desired line length. However, use of frictional locking slots 17 and 18 are preferred. As is explained in fuller detail in my U.S. Pat. No. Re. 30,406, slot 17 and slot 18 are cut into the body from diametrically opposite sides a distance greater than the radius of 31. Slots 17 and 18 are thereafter compressed as shown in FIG. 3 to provide the desired frictional loading between the threads of 11, 12 and the interior threads of 10.

To minimize undesired signal reflections, the impedance of the phase trimmer should be made to match that of the coupled lines. For RG-405 and RG-402 cable which have impedances of 50 ohms, the following are dimensions of an operable phase trimmer:

(1) minimum travel length 0.8 inch
(2) maximum travel length 1.02 inch
(3) mechanical adjustment 7 turns (2520°)
(4) phase adjustment −30° at 8.2 GHz −50° at 12.4 GHz Materials chosen for manufacturing the present phase-trimmer are brass, beryllium, and copper. In certain applications, conductive plastics may be used.

Although the invention has been described in connection with a preferred embodiment thereof, it will be appreciated by those skilled in the art that various changes and modifications can be made without departing from the same.

I claim:

1. An adjustable length radio frequency coaxial transmission line coupler comprising:

(a) a turnbuckle sleeve having an open interior cylindrical wall surface, opposite open ends of said interior sleeve wall surface having threads of opposite pitch;

(b) a pair of coupling sleeves, each having an outer cylindrical surface that is threaded to mate with one of the threaded interior wall surfaces at opposite ends of said turnbuckle, and each having cylindrical internal surfaces which form electrical contact with the respective cylindrical outer shields of connecting coaxial cables;

(c) a central coaxial conductor comprising telescoping male and female connectors slidably connected at their central inner most ends, said male and female connectors each having means for connection to one of the central conductors of the connecting coaxial cables, whereby the effective electrical length of the coupler and the spacing of the connecting coaxial cables may be altered by rotational adjustment of said turnbuckle sleeve without rotation of either of said connecting coaxial cables.

2. Apparatus in accordance with claim 1 wherein at least one of said coupling sleeves includes a slot formed in a non-threaded portion of the sleeve, said slot extending radially inwardly a distance substantially greater than the radius of said sleeve.

3. Apparatus in accordance with claim 1 wherein at least one of said coupling sleeves includes a pair of slots of equal depth formed in a non-threaded portion of the sleeve, said slots extending radially inwardly from diametrically opposed portions of the outer surface of said sleeve and extending a distance substantially greater than the radius of said sleeve.

4. Apparatus in accordance with either of claims 1 or 2 wherein a pair of locknuts are provided having a threaded internal bore which matches the threaded outer cylindrical surfaces of said coupling sleeve.

* * * * *